US007783219B2

(12) United States Patent
Maeda

(10) Patent No.: US 7,783,219 B2
(45) Date of Patent: Aug. 24, 2010

(54) FIXING APPARATUS HAVING A FIXING MEMBER AND AN EXTERNAL HEATING DEVICE, AND IMAGE FORMING APPARATUS INCLUDING THE SAME

(75) Inventor: Tomohiro Maeda, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 776 days.

(21) Appl. No.: 11/684,207

(22) Filed: Mar. 9, 2007

(65) Prior Publication Data

US 2007/0217808 A1 Sep. 20, 2007

(30) Foreign Application Priority Data

Mar. 14, 2006 (JP) ..... 2006-069983

(51) Int. Cl.
*G03G 15/20* (2006.01)

(52) U.S. Cl. ..... 399/69

(58) Field of Classification Search ..... 399/69, 399/329, 330; 219/216
See application file for complete search history.

(56) References Cited

U.S. PATENT DOCUMENTS

| | | | | |
|---|---|---|---|---|
| 6,137,985 | A * | 10/2000 | Kinouchi et al. | 399/329 |
| 6,643,490 | B2 * | 11/2003 | Regimbal | 399/329 |
| 7,107,001 | B2 * | 9/2006 | Kameda | 399/330 |
| 2004/0052556 | A1 * | 3/2004 | Regimbal | 399/329 |
| 2005/0117942 | A1 | 6/2005 | Ishii et al. | |
| 2005/0185978 | A1 * | 8/2005 | Kemmochi | 399/69 |
| 2006/0245796 | A1 * | 11/2006 | Wu et al. | |
| 2007/0014600 | A1 * | 1/2007 | Ishii et al. | 399/329 |

FOREIGN PATENT DOCUMENTS

| | | |
|---|---|---|
| JP | 52-017031 | 2/1977 |
| JP | 11-038802 | 2/1999 |
| JP | 2002-182503 | 6/2002 |
| JP | 2005-189427 | 7/2005 |
| JP | 2005-292714 | 10/2005 |

* cited by examiner

*Primary Examiner*—Susan S Lee
(74) *Attorney, Agent, or Firm*—Renner, Otto, Boisselle & Sklar, LLP

(57) ABSTRACT

A fixing apparatus includes an external heating device which has a halogen lamp and is disposed on the outer surface of a fixing member so that a nip area is provided between the external heating device and the fixing member. A temperature difference between a surface temperature of the external heating device and a surface temperature of the fixing member is controlled in accordance with a length of the nip area in a direction of transport of the recording paper, so that the surface temperature of the fixing roller is maintained to fall within a temperature range in which offset does not occur, the offset being a phenomenon in which part of a toner formed on the recording paper sticks onto the surface of the fixing roller.

16 Claims, 10 Drawing Sheets

FIG. 6

OVERSHOOT AND UNDERSHOOT OF FIXING ROLLER SURFACE IMMEDIATELY AFTER COMPLETION OF WARM-UP (NEGATIVE VALUES INDICATE UNDERSHOOT)

| | LENGTH OF NIP BETWEEN EXTERNAL BELT AND FIXING ROLLER | | |
|---|---|---|---|
| TEMPERATURE DIFFERENCE | 3mm | 10mm | 20mm |
| 0°C | | | 6°C |
| 5°C | 12°C | 10°C | 5°C |
| 15°C | | 5°C | |
| 20°C | | | -3°C |
| 25°C | | | -5°C |
| 30°C | | -3°C | |
| 35°C | 5°C | -5°C | -18°C |
| 40°C | | | |
| 60°C | -5°C | | |

FIG. 9

SAME TRANSPORT SPEED IN COLOR MODE AND MONOCHROME MODE

| FIXING TEMPERATURE | COLOR | MONOCHROME |
|---|---|---|
| 220°C | H | H |
| 210°C | H | H |
| 200°C | H | ○ |
| 190°C | ○ | ○ |
| 180°C | ○ | ○ |
| 170°C | ○ | ○ |
| 160°C | ○ | ○ |
| 150°C | C | C |

H : HOT OFFSET
C : COLD OFFSET
○ : EXCELLENT FIXING

COMMON NON-OFFSET RANGE

FIG. 10

TRANSPORT SPEED IN COLOR MODE: 170 mm/s
TRANSPORT SPEED IN MONOCHROME MODE: 350 mm/s

| FIXING TEMPERATURE | COLOR | MONOCHROME |
|---|---|---|
| 220°C | H | H |
| 210°C | H | ○ |
| 200°C | H | ○ |
| 190°C | ○ | ○ |
| 180°C | ○ | ○ |
| 170°C | ○ | C |
| 160°C | ○ | C |
| 150°C | C | C |

H: HOT OFFSET
C: COLD OFFSET
○: EXCELLENT FIXING

COMMON NON-OFFSET RANGE

FIXING APPARATUS HAVING A FIXING MEMBER AND AN EXTERNAL HEATING DEVICE, AND IMAGE FORMING APPARATUS INCLUDING THE SAME

This Nonprovisional application claims priority under 35 U.S.C. §119(a) on Patent Application No. 69983/2006 filed in Japan on Mar. 14, 2006, the entire contents of which are hereby incorporated by reference.

FIELD OF THE INVENTION

The present invention relates to a fixing apparatus which fixes an unfixed toner image formed on a recording paper by contact fusing in an image forming apparatus such as a copying machine, a printer, a facsimile machine.

BACKGROUND OF THE INVENTION

An electrophotographic image forming apparatus (e.g. printer) includes a fixing apparatus that fuses a toner image formed on a paper sheet so as to fix the toner image on the paper sheet. Known as an example of the fixing apparatus is a fixing apparatus which includes a pair of rollers, a fixing roller and a pressure roller, as shown in Patent documents 1 through 4 below.

The fixing roller is a roller member that has (a) a hollow shaft which is made of metal such as aluminum, (b) an elastic layer which is formed on the surface of the hollow shaft, and (c) a halogen lamp which is disposed as a heat source inside the shaft. A temperature control device controls a temperature of the fixing roller by performing on-off control of the halogen lamp in accordance with a signal outputted from a temperature sensor which is provided on the surface of the fixing roller.

Apart from the aforementioned halogen lamp, an external heating member which is pressed against the outer surface of the fixing roller is known as means for heating the fixing roller. Specific examples of the external heating member include an external heating roller which is disclosed in Patent document 1 and an external heating belt which is disclosed in Patent documents 2 through 4. Since the external heating member directly contacts the outer surface of the fixing roller, the external heating member can heat the outer surface of the fixing roller more quickly than the aforementioned halogen lamp.

The pressure roller is a roller member which has a shaft and a heat-resistant elastic layer provided as a covering layer around the shaft. The heat-resistant elastic layer is made of a silicone rubber, for example. The pressure roller is pressed against the outer surface of the fixing roller, which causes elastic deformation of the elastic layer of the pressure roller. This provides a nip region between the fixing roller and the pressure roller.

In the above arrangement, a fixing apparatus is such that a paper sheet having unfixed toner image formed thereon is caught in the nip region between the fixing roller and the pressure roller and transported by rotation of the fixing roller and the pressure roller, and then the toner image formed on the paper sheet is fused by heat given off from the outer surface of the fixing roller so that the toner image can be fixed on the paper sheet.

In such a fixing apparatus, it is known that offset phenomenon such as cold offset and hot offset occurs when a temperature on the outer surface of the fixing roller falls outside an appropriate temperature range. The cold offset is a phenomenon in which due to lack of the amount of heat transferred to a paper sheet, a part of insufficiently melted toner sticks to the fixing roller. The hot offset is a phenomenon in which due to overheating of a toner on a paper sheet, a cohesive force of the toner decreases, and a part of the toner on the paper sheet sticks to the fixing roller.

Thus, in order to prevent such cold offset and hot offset, it is very important for the fixing apparatus to control a temperature of the fixing roller so that a temperature on the surface of the fixing roller is within the appropriate temperature range during sheet passing.

Patent document 1:

Japanese Unexamined Patent Publication No. 038802/1999 (Tokukaihei 11-038802; published on Feb. 12, 1999)

Patent document 2:

Japanese Unexamined Patent Publication No. 189427/2005 (Tokukai 2005-189427; published on Jul. 14, 2005)

Patent document 3:

Japanese Unexamined Patent Publication No. 292714/2005 (Tokukai 2005-292714; published on Oct. 20, 2005)

Patent document 4:

Japanese Unexamined Patent Publication No. 017031/1977 (Tokukaisho 52-017031; published on Feb. 8, 1977)

The appropriate temperature range of the outer surface of the fixing roller varies depending upon a paper transport speed of an image forming apparatus into which the fixing apparatus is installed. More specifically, the appropriate temperature range tends to shift to higher temperatures with increase of the paper transport speed (process speed) and shifts to lower temperatures with decrease of the paper transport speed. The reasons for the tendency are as follows. In cases where the paper transport speed is high, a time for the contact between the paper sheet and the outer surface of the fixing roller is short. Hence, sufficient heat is not transmitted from the outer surface of the fixing roller to the paper sheet unless a temperature on the outer surface of the fixing roller is relatively high. On the other hand, in cases where the paper transport speed is low, the contact time is long. Hence, excessive heat is transferred from the outer surface of the fixing roller to a paper sheet unless the temperature on the outer surface of the fixing roller is suppressed.

The so-called 4-cycle electrophotographic image forming apparatus is usually designed to have a substantially identical paper transport speed in (a) cases where a color image is formed on a paper sheet and (b) cases where a monochrome image is formed thereon (It is to be noted that an interval between the sheets of paper transported is different in the color image formation and monochrome image formation, and the number of sheets processed per unit time are therefore larger in the monochrome image formation.). Note that the 4-cycle electrophotographic image forming apparatus has a scheme in which one visible image forming unit forms toner images of four colors CMYK and has the toner images overlapped so as to form a color image.

In a fixing apparatus included in the 4-cycle electrophotographic image forming apparatus, when the appropriate temperature range (non-offset range) to fix color images is compared with the non-offset range to fix monochrome images, overlap range, i.e. common non-offset range exists between both of the non-offset ranges, and the common non-offset range is wide, as illustrated in FIG. 9. Therefore, by setting a control value (setting value) of a temperature of the surface of the fixing roller so as to fall within the common non-offset range, it becomes easy to perform temperature control such that a temperature of the outer surface of the fixing roller falls within an appropriate temperature range both in the case of color image fixing and the case of monochrome image fixing. This makes it possible to easily avoid the occurrence of the offset phenomena.

However, as to a recent four drum tandem engine image forming apparatus, i.e. image forming apparatus in which four visible image forming units corresponding to the four colors CMYK are disposed, a demand for designing to have a higher paper transport speed in forming a monochrome image on a paper sheet than in forming a monochrome image thereon has been increasing. According to this demand, paper transport speeds are greatly different between in monochrome image forming mode and in color image forming mode. This is because the image forming apparatus designed as above can increase the number of paper sheets processed for monochrome image without degrading image quality of a monochrome image formed.

As described above, in an image forming apparatus which is designed to increase the number of sheets processed for monochrome image, the non-offset range to fix color image and the non-offset range to fix monochrome image have a very narrow common non-offset range, as illustrated in FIG. 10. Thus, in cases where the common non-offset range is very narrow, it is difficult to perform temperature control for a surface temperature of the fixing roller falling within the common non-offset range even when a control value (setting value) for a surface temperature of the fixing roller is set so as to fall within the common non-offset range. In this case, the cold offset problem and hot offset problem are likely to occur.

Additionally, in paper passing operation following a standby state in the fixing apparatus, it is necessary to set the surface temperature of the fixing roller to a temperature at which a paper sheet can be passed in both the monochrome mode and the color mode. Thus, it is necessary to perform temperature control with respect to the fixing roller in such a manner a surface temperature of the fixing roller in a standby state is controlled to a temperature between a fixable lower limit temperature in the monochrome mode and a fixable upper limit temperature in the color mode so that switching between the monochrome mode and the color mode can be performed at a paper passing operation following the standby state.

Furthermore, undershoot or overshoot of a surface temperature of the fixing roller immediately after the completion of a warm-up of the fixing apparatus, causes the surface temperature of the fixing roller to fall outside the common non-offset range. When the fixing apparatus enters into the paper passing operation from the above-mentioned state, cold offset or hot offset is likely to occur in an early stage of the paper passing operation.

SUMMARY OF THE INVENTION

An object of the present invention is to provide a fixing apparatus which is used in, for example, an image forming apparatus enabling switching between transport speeds of a paper sheet and has a narrow common non-offset range, wherein undershoot and overshoot of the surface temperature of the fixing roller is suppressed so that it is possible to fix an image on a paper sheet without toner offset phenomenon even when the paper passing operation is performed immediately after the completion of the warm-up.

A fixing apparatus of the present invention includes a fixing member which has a heat source and an elastic layer therein, the elastic layer being located close to an outer surface of the fixing member in relation to the heat source; a pressure member which is pressed against the fixing member so that a first nip area is provided between the pressure member and the fixing member, the first nip area causing a toner image formed on a recording paper to be fixed on the recording paper; and an external heating device which has a heat source and is disposed on the outer surface of the fixing member so that a second nip area is provided between the external heating device and the fixing member, wherein a temperature difference between a surface temperature of the external heating device and a surface temperature of the fixing member is controlled in accordance with a length of the second nip area in a direction of transport of the recording paper, so that the surface temperature of the fixing member is maintained to fall within a temperature range in which offset does not occur, the offset being a phenomenon in which part of a toner formed on the recording paper sticks onto a surface of the fixing member due to overheating or insufficient heating of the recording paper.

According to the above arrangement, the temperature difference between the surface temperature of the external heating device and the surface temperature of the surface temperature is controlled in accordance with the length of the second nip area in a direction of transport of the recording paper. This control is performed to maintain the surface temperature of the fixing member so as to fall within a temperature range in which offset does not occur. The offset is a phenomenon in which part of a toner formed on the recording paper sticks onto a surface of the fixing member due to overheating or insufficient heating of the recording paper. Thus, it is possible to fix an image on a paper sheet without toner offset phenomenon even when paper passing operation is performed immediately after the completion of warm-up.

More specifically, for example, a fixing member having an elastic layer as a surficial section is coated with the surficial section of a poor heat conductivity, which is made of rubber, for example. For this reason, in a case where a temperature of the fixing member is increased only by the heat source provided inside the fixing member, there occurs a significant difference in temperature between an internal section (e.g. inside the shaft) and the surficial section. Accordingly, in a case where the heat source is turned off at the time when the surface temperature of the fixing member reaches a control temperature (setting temperature), heat from the internal section is transmitted to the surficial section in late. This causes overshoot of the surface temperature of the fixing member. Meanwhile, in a case where the fixing member is heated from the surface thereof only by the external heating device so that a temperature of the fixing member increases, a temperature of the internal section of the fixing member is lower than that of the surficial section of the fixing member at the time when the surface temperature of the fixing member reaches the control temperature (setting temperature). Accordingly, in a case where the heat source is turned off at the time when the surface temperature of the fixing member reaches a control temperature (setting temperature), heat of the surficial section is transmitted to the internal section in late. This causes undershoot of the surface temperature of the fixing member.

In a case where the paper passing operation is performed in the above-mentioned state, i.e. in a state where the surface temperature of the fixing member undershoots or overshoots after the completion of the warm-up of the fixing member, a fixed image formed on the recording paper which is obtained in the early stage of the paper passage through the fixing apparatus is a defective image caused by cold offset or hot offset. Thus, in the fixing apparatus, it is necessary to perform control so that cold offset or hot offset does not occur, i.e. so that the surface temperature of the fixing member does not undershoot or overshoot after the completion of the warm-up.

In view of this, in the fixing apparatus, a temperature difference between the surface temperature of the external heating device and the surface temperature of the fixing member is controlled in accordance with a length of the second nip area in a direction of transport of the recording paper, so that the surface temperature of the fixing member is maintained to fall within a temperature range in which cold offset or hot offset does not occur.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 6 is an explanatory view illustrating a relationship between (a) a difference in surface temperature between the external heating device and the fixing roller, (b) a nip length of a nip area provided between the external heating device and the fixing roller, and (c) undershoot and overshoot of the surface temperature of the fixing roller after the completion of a warm-up in the fixing apparatus illustrated in FIG. 1.

FIG. 9 is an explanatory view illustrating a common non-offset range between fixing of a monochrome image and fixing of a color image in a fixing apparatus included in a 4-cycle image forming apparatus.

FIG. 10 is an explanatory view illustrating a common non-offset range between fixing of a monochrome image and fixing of a color image in a fixing apparatus included in a four drum tandem engine image forming apparatus.

DESCRIPTION OF THE EMBODIMENTS

Figure 1:
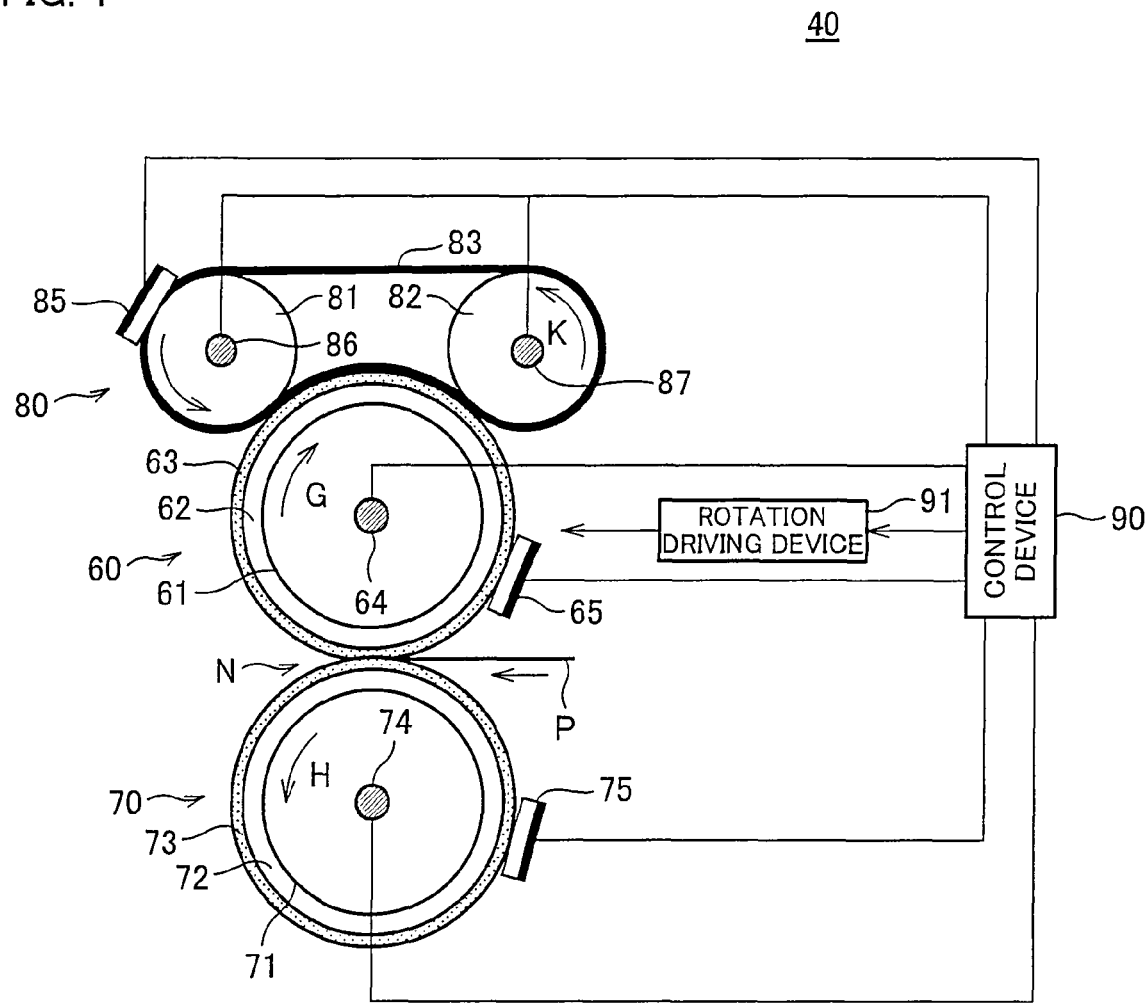
FIG. 1 is a diagram schematically illustrating the structure of a fixing apparatus according to one embodiment of the present invention.

The following will describe one embodiment of the present invention with reference to drawings. A fixing apparatus of the present embodiment is, for example, a color fixing apparatus which varies a process speed according to a process mode. As illustrated in FIG. 1, a fixing apparatus 40 includes: a fixing roller (fixing member) 60 having an elastic layer 62; a pressure roller 70 (pressure member) having an elastic layer 72; an external heating device 80 which heats the fixing roller 60 from the outside of the fixing roller 60. The external heating device 80 has an endless belt 83 which is set over a plurality of heating rollers (heating rollers 81 and 82). The fixing apparatus 40 (i) improves the problems of overshoot and undershoot of a surface temperature of the fixing roller 60 immediately after the end of warm-up, and (ii) prevents cold offset and hot offset of toner at the printing.

Figure 2:
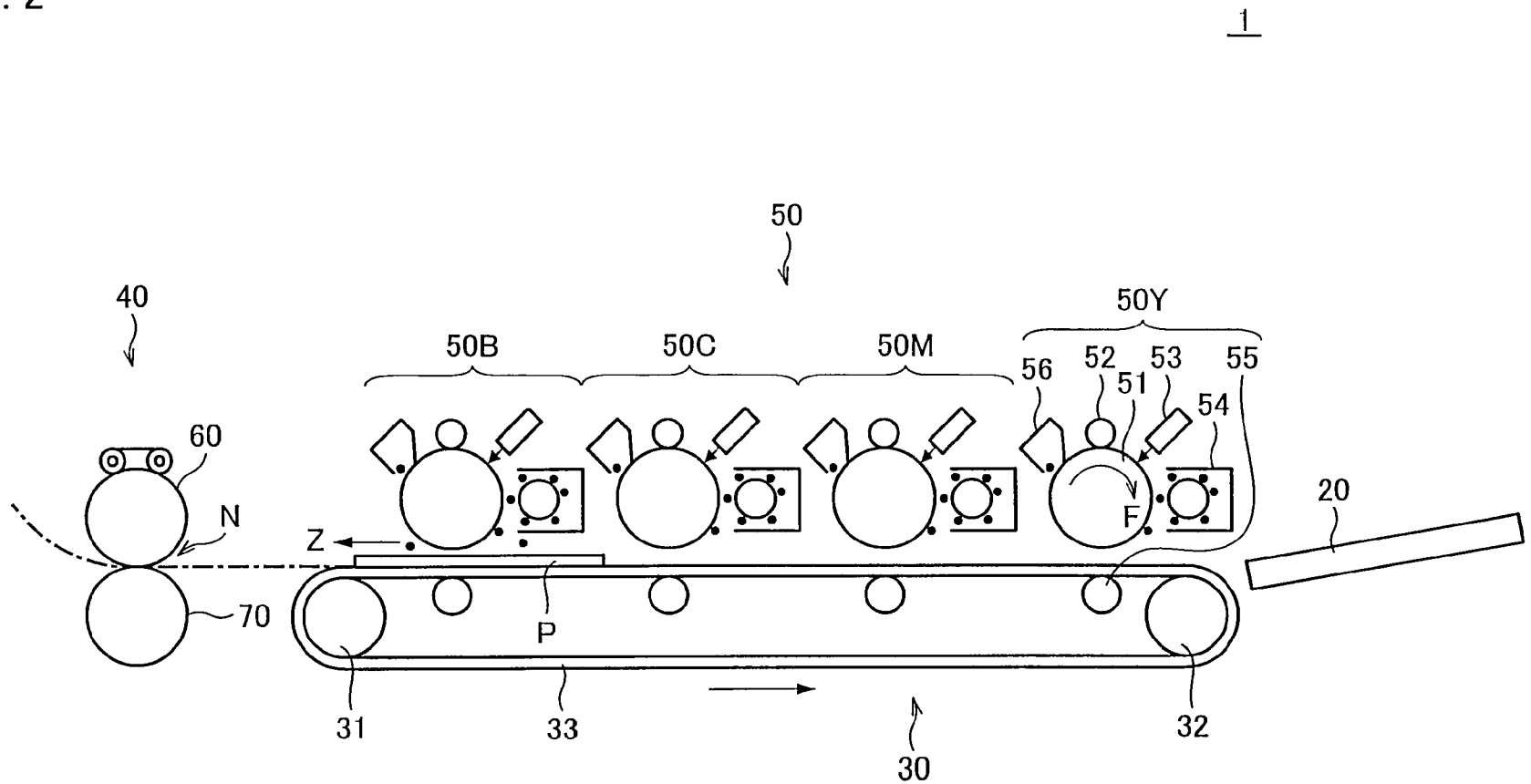
FIG. 2 is a diagram illustrating internal structure of an image forming apparatus including the fixing apparatus illustrated in FIG. 1.

First of all, an image forming apparatus of one embodiment of the preset invention is described with reference to FIG. 2. FIG. 2 is a diagram illustrating an internal structure of a xerographic color image forming apparatus. An image forming apparatus 1 forms multicolor or monochrome images on predetermined recording sheets in accordance with image data or the like supplied from terminal devices on a network, for example.

The image forming apparatus 1 includes a visible image forming section 50, a sheet transporting section 30, a fixing apparatus 40, and a paper feed tray 20.

In the visible image forming section 50, four visible image forming units 50Y, 50M, 50C, 50B are arranged respectively corresponding to yellow (Y), magenta (M), cyan (C), and black (B). The visible image forming unit 50Y performs image formation by using a yellow (Y) toner. The visible image forming unit 50M performs image formation by using a magenta (M) toner. The visible image forming unit 50C performs image formation by using a cyan (C) toner. The visible image forming unit 50B performs image formation by using a black (B) toner. Specifically, the image forming apparatus 1 is the so-called tandem engine image forming apparatus that includes four visible image forming units 50Y, 50M, 50C, 50B disposed along a direction in which a recording paper P is transported on the sheet transporting section 30.

The visible image forming sections 50Y, 50M, 50C, 50B, which have substantially the same structure, form a yellow image, a magenta image, a cyan image, and a black image, respectively, in accordance with image data and then transfer the yellow image, the magenta image, the cyan image, and the black image, respectively, on the recording paper P transported from the sheet transporting section 30 by superimposing the images one after another.

More specifically, each of the visible image forming units 50Y, 50M, 50C, 50B includes a photoreceptor drum 51, an electrostatic charging roller 52, a laser beam scanner unit 53, a developing unit 54, a transfer roller 55, and a cleaning unit 56.

On a surface of the photoreceptor drum 51, a toner image is formed. The photoreceptor drum 51 holds the toner image. The electrostatic charging roller 52 evenly charges the surface of the photoreceptor drum 51 at a predetermined potential. The laser beam scanner unit 53 perform exposures of the surface of the photoreceptor drum 51 having been charged by the electrostatic charging roller 52 and forms an electrostatic latent image on the surface of the photoreceptor drum 51 in accordance with the image data supplied to the image forming apparatus 1. The developing unit 52 develops, with a toner, the electrostatic latent image formed on the photoreceptor drum 51 to form a toner image. The transfer roller 55 is subjected to application of a bias voltage which is opposite in polarity to toner, thereby transferring the toner image formed on the surface of the photoreceptor drum 51 onto the recording paper P transported from the sheet transporting section 30. Such a toner image transfer onto the recording paper P is carried out once for each color. The cleaner unit 56 removes and collects residual toner remaining on the surface of the photoreceptor drum 51 after the development process by the developing unit 52 and the transferring process by the transfer roller 55.

The sheet transporting section 30 is composed of a drive roller 31, a driven roller 32, and a transport belt 33. The sheet transporting section 30 transports the recording paper P so that the visible image forming section 50 forms the toner images on the recording paper P. The endless transport belt 33 is set over the drive roller 31 and the driven roller 32, and is rotated by rotation of the drive roller 31 at a predetermined circumferential speed under control. The transport belt 33, which builds up static electricity on its outer surface, transports the recording paper P while having the recording paper P adsorbed to the transport belt 33 in an electrostatic manner. The recording paper P which has been subjected to toner image transfer and transported by the sheet transporting section 30 is separated from the transport belt 33 at a position of the drive roller 31 and then transported to the fixing apparatus 40.

The fixing apparatus 40 gives suitable temperature and pressure to the recording paper P. As a result, the toner fuses and is fixed on the recording paper P, so that a rigid image is formed. The fixing apparatus 40 includes a fixing roller 60 and a pressure roller 70. The recording paper P having been transported by the sheet transporting section 30 is fed to a fixing nip area N which is provided between the fixing roller 60 and pressure roller 70. The paper sheet P is transported between the fixing roller 60 and the pressure roller 70. During the transport, the toner images (unfixed images) formed on the recording paper P are fused by heat of an outer surface of the fixing roller 60 and fixed to the paper sheet P.

The image forming apparatus 1 operates at a process speed of 170 mm/s (at a speed such that 40 sheets per minute are continuously passed) in a color mode and at a process speed of 350 mm/s (at a speed such that 70 sheets per minute are continuously passed) in a monochrome mode. That is, the image forming apparatus 1 has process speeds that are different between the color mode and the monochrome mode.

Next, details of the fixing apparatus 40 is described with reference to FIG. 1. FIG. 1 is a diagram schematically illustrating a structure of the fixing apparatus 40. The fixing apparatus 40 includes, in addition to the fixing roller 60 and the pressure roller 70, an external heating device 80, thermistors (temperature detecting elements) 65, 75, 85, a control device 90, a rotation driving device 91. The thermistors 65, 75, 85 detect a surface temperature of the fixing roller 60, a surface temperature of the pressure roller 70, and a surface temperature of the external heating device 80, respectively.

The fixing roller 60 is a roller that rotates in a direction indicated by an arrow G, as illustrated in FIG. 1. The fixing roller 60 is provided with a hollow cylindrical shaft 61 that is made of a metal, an elastic layer 62 that coats the perimeter of the shaft 61, and a release layer 63 that is formed to coat the elastic layer 62. The shaft 61 includes a halogen lamp 64 as a heat source provided therein.

The shaft 61 is made of aluminum, for example, and is a hollow-shaped shaft (cylindrical-shaped shaft) having an external diameter of 46 mm. However, a material for the shaft 61 is not limited to aluminum and may be ferrous metal.

The elastic layer 62 has a thickness of 2 mm, for example, and is made of silicone rubber having heat resistance. A material for the release layer 63 may be anything, provided that it is excellent in heat resistance, durability, and toner releasing property. Specifically, the material for the release layer 63 is fluorine material such as PFA (tetrafluoroethylene-perfluoroalkyl vinyl ether copolymer) or PTFE (polytetrafluoroethylene). In the present embodiment, the release layer 63 is a PFA tube having a thickness of approximately 30 μm. The fixing roller 60 arranged in such a manner has an external diameter of 50 mm and a surface hardness of 68 degrees (Asker-C hardness).

In the present embodiment, the number of the halogen lamp 64 is only one. However, two halogen lamps 64 which are lit according to a size of a recording paper may be provided, one for a small-size recoding paper and one for a large-size recording paper, so that temperature distributions suitable for sizes of the recording paper P are made.

The thermistor 65 is provided so as to be come into contact with a surface of the release layer 63. In the present embodiment, the thermistor 65 is disposed at a middle section of the fixing roller 60 in an axial direction of the fixing roller 60. However, the thermistor 65 may be disposed at an end section (non-paper passing area) of the fixing roller 60 in the axial direction of the fixing roller 60. In an arrangement in which two halogen lamps 64 of different sizes are disposed inside the shaft 61, and temperatures of the fixing roller 60 are different between at the middle section and at the end section in the axial direction of the fixing roller 60, two thermistors 65 may be provided, one for the middle section of the fixing roller 60 and one for the end section of the fixing roller 60.

The pressure roller 70 is a roller that rotates in a direction indicated by an arrow H (opposite to the direction indicated by the arrow G). The pressure roller 70 is provided with a hollow cylindrical shaft 71 that is made of a metal, an elastic layer 72 that coats the perimeter of the shaft 71, and a release layer 73 that is formed to coat the elastic layer 72. The shaft 71 includes a halogen lamp 74 as a heat source provided therein. The pressure roller 70 is pressed against the fixing roller 60 by, for example, an elastic member realized by a spring (not shown). This provides a nip area (fixing nip area N) between the fixing roller 60 and the pressure roller 70.

The shaft 71 is made of aluminum, for example, and is a hollow-shaped shaft (cylindrical-shaped shaft) having an external diameter of 46 mm. However, a material for the shaft 61 is not limited to aluminum and may be ferrous metal.

The elastic layer 72 has a thickness of 2 mm, for example, and is made of silicone rubber having heat resistance. A material for the release layer 73 may be anything, provided that it is excellent in heat resistance, durability, and toner releasing property. Specifically, the material for the release layer 73 is fluorine material such as PFA (tetrafluoroethylene-perfluoroalkyl vinyl ether copolymer) or PTFE (polytetrafluoroethylene). In the present embodiment, the release layer 73 is a PFA tube having a thickness of approximately 30 μm. The pressure roller 70 arranged in such a manner has an external diameter of 50 mm and a surface hardness of 75 degrees (Asker-C hardness).

The thermistor 75 is provided so as to come into contact with the surface of the release layer 73. The thermistor 75 is disposed as in the case of the thermistor 65.

In the fixing apparatus 40, a rubber hardness of the pressure roller 70 is higher than a rubber hardness of the fixing roller 60, so that the fixing nip area N has a reverse nip shape. The reverse nip shape takes a form such that the fixing nip area N is bowed in a convex manner since the pressure roller 70 is convex and the fixing roller 60 is concave at the fixing nip area N.

The fixing nip area N has the reverse nip shape, thereby making the recording paper P which passes through the fixing nip area N bowed in a direction in which ends of the recording paper P point downward, i.e. in a direction along the pressure roller 70. This arrangement makes it easy for the recording paper P to make self-separation from the fixing roller 60 in making the toner images fixed on the recording paper P. The self-separation is separation occurred by stiffness of the recording paper P itself. This allows for the separation which reduces dependence on a forced separating aiding means such as a separation claw. Thus, in the fixing apparatus 40 in which the fixing nip area N has the reverse nip shape, an arrangement in which the self-separation capability and the separation claw are provided makes it possible to provide a sufficient property of separating the recording paper P from the fixing roller 60. In the present embodiment, the fixing nip area N has a nip length of 8.5 mm.

Suppose that a surface hardness of the pressure roller 70 is lower than that of the elastic layer 62 of the fixing roller 60. In this case, the fixing nip area N has a normal nip shape and is bowed in a concave manner. Therefore, the recording paper P which passes through the fixing nip area N is made bowed in a direction in which ends of the recording paper P point upward, i.e. in a direction along the fixing roller 60. The fixing apparatus 40 arranged in such a manner cannot obtain a sufficient self-separation property.

The external heating device 80 includes two heating rollers 81 and 82 and the endless belt 83 which is set over the heating rollers 81 and 82. The heating rollers 81 and 82 are pressed against the fixing roller 60 via the endless belt 83 by, for example, an elastic member realized by spring (not shown). This provides a nip area between the fixing roller 60 and the external heating device 80.

The external heating device 80 has the arrangement in which the endless belt 83 is supported by the two heating rollers 81 and 82. If necessary, the external heating device 80 may also have an arrangement in which a tension roller (not shown) is provided so as to make the endless belt 83 under an appropriate tension. In such an arrangement in which the tension roller is provided, even in a case where the endless belt 83 is wrapped around the fixing roller 60 in a large area (pressed against the fixing roller 60 in a large area) in order to provide a large nip area between the fixing roller 60 and the endless belt 83, it is possible to support the endless belt 83 in such a state that an appropriate tension is maintained.

The heating rollers 81 and 82 of the external heating device 80 may be rollers each of which is realized by a shaft made of aluminum and having an external diameter of 15 mm and a thickness of 1 mm. If necessary, for example, in order to reduce deviation force of the endless belt 83 (force which causes the endless belt 83 to move in a direction perpendicular to a rotational direction) caused by travel of the endless belt 83 in a meandering manner by reducing frictional forces produced between the inner surface of the endless belt 83 and the heating roller 81 and between the inner surface of the endless belt 83 and the heating roller 82), the heating rollers 81 and 82 each may be made up of the shaft and a release layer formed on the shaft. A material for the release layer may be anything, provided that it is excellent in heat resistance, durability, and toner releasing property. The material for the release layer can be fluorine material such as PFA (tetrafluoroethylene-perfluoroalkyl vinyl ether copolymer) or PTFE (polytetrafluoroethylene).

The heating rollers 81 and 82 include halogen lamps 86 and 87 as heat sources provided therein, respectively. Specifically, the halogen lamp 86 is provided inside the shaft of the heating roller 81, and the halogen lamp 87 is provided inside the shaft of the heating roller 82.

In the present embodiment, the endless belt 83 is a belt which is made up of (a) a polyimide belt base material having an external diameter of 30 mm and a thickness of 90 μm and (b) a 10 μm-thick release layer (PTFE). A thickness of the belt base material and a material for the belt base material are not limited to this. For example, the material for the belt base material may be metal such as nickel, stainless steel, or iron. A material for the release layer may be anything, provided that it is excellent in heat resistance, durability, and toner releasing property. The material for the release layer may be fluorine material such as PFA (tetrafluoroethylene-perfluoroalkyl vinyl ether copolymer) or PTFE (polytetrafluoroethylene).

As described above, the external heating device 80, which has the two thin heating rollers 81 and 82 having a small diameter and the thin endless belt 83, makes it possible to quickly increase a temperature of the fixing roller 60.

The thermistor 85 is provided so as to come in contact with a surface of the endless belt 83. Specifically, the thermistor 85 is provided so as to come into contact with the endless belt 83 at a position corresponding to the heating roller 81.

In the present embodiment, the external heating device 80 has the heating rollers 81 and 82 which are of identical shape with each other (under the same standard), and the halogen lamps 86 and 87, as heat sources, which are identical with each other (under the same standard). Thus, the thermistor 85 for detecting a surface temperature of the endless belt 83 is provided to one of the heating rollers, i.e. the heating roller 81. That is, only one thermistor 85 is provided.

Note that the heating rollers 81 and 82 are not necessarily identical in shape. However, in a case where the heating rollers 81 and 82 are of different shape, two thermistors must be disposed on the endless belt 83 so as to detect temperatures of the heating rollers 81 and 82, respectively.

The heating rollers 81 and 82 of the external heating device 80 are pressed against the fixing roller 60 via the endless belt 83 by, for example, an elastic member realized by a spring (not shown). This provides a nip area between the fixing roller 60 and the heating rollers 81 and 82. In the present embodiment, a length of the nip area is 20 mm.

The control device 90 controls respective temperatures and operations of the fixing roller 60, the pressure roller 70, and the external heating device 80. The control device 90 includes CPU (Central Processing Unit) therein. The control device 90 directly controls (i) power sources (not shown) which supply power to the respective halogen lamps 64, 74, 86, and 87 of the fixing roller 60, the pressure roller 70, and the external heating device 80 and (ii) the rotation driving device 91 which drives the fixing roller 60.

Temperature ranges (non-offset ranges) where the fixing apparatus 40 is able to perform fixing at the printing in the monochrome mode (transport speed of 350 mm/s) and in the color mode (transport speed of 170 mm/s) were measured. In the present embodiment, the non-offset range was from 180° C. to 210° C. in the monochrome mode and from 160° C. to 190° C. in the color mode. That is, in the monochrome mode, fixing failure occurred at temperatures lower than 180° C., and high temperature offset occurred at temperatures higher than 210° C. On the other hand, in the color mode, fixing failure occurred at temperatures lower than 160° C., and high temperature offset occurred at temperatures higher than 190° C. Therefore, a common non-offset range between the monochrome mode and the color mode was from 180° C. to 190° C. (see FIG. 10).

In the fixing apparatus 40, it is clear from the above result that even when the recording paper P is passed through the fixing apparatus 40 immediately after the completion of the warm-up (or immediately after a return from the standby state), an excellent image is obtained on the recording paper P without cold offset or hot offset by maintaining the surface temperature of the fixing roller 60 in a range from 180° C. to 190° C. immediately after the completion of the warm-up (or immediately after a return from the standby state).

Figure 3:
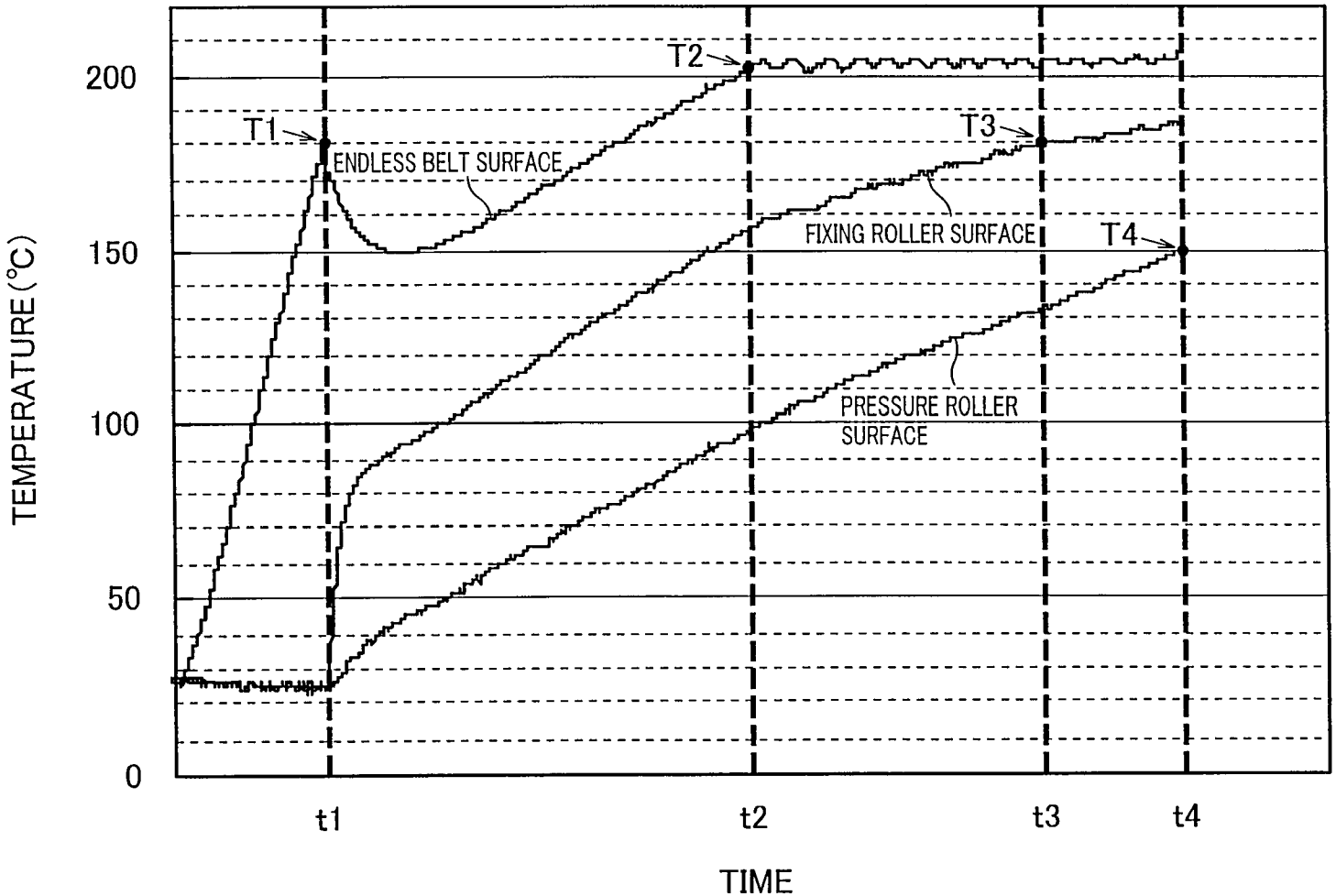
FIG. 3 is a graph showing changes in surface temperatures of an endless belt, a fixing roller, and a pressure roller in the fixing apparatus illustrated in FIG. 1 during a warm-up time.
Figure 4:
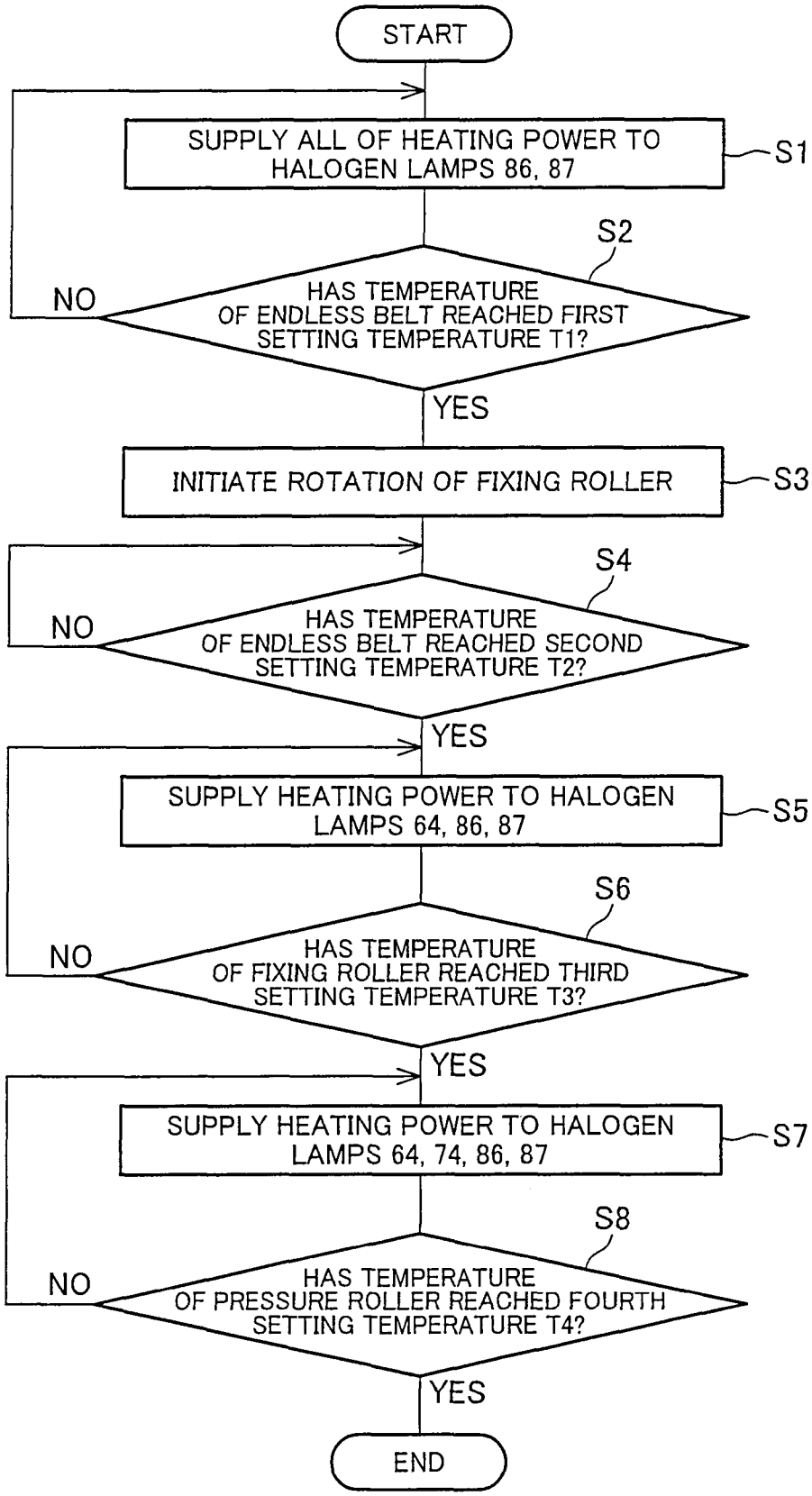
FIG. 4 is a flow chart illustrating a flow of control performed by a control device of the fixing apparatus illustrated in FIG. 1 during a warm-up.

Next, control performed with respect to the above-arranged fixing apparatus 40 during a warm-up time between the start of the warm-up at a room temperature and the completion of the warm-up are described in detail with reference to FIGS. 3 and 4. FIG. 3 is a graph showing changes in surface temperatures of the external heating device 80 (endless belt 83), the fixing roller 60, and the pressure roller 70 in the fixing apparatus 40 during a warm-up time between the start of the warm-up at a room temperature and the completion of the warm-up. FIG. 4 is a flow chart showing control operations of the control device 90 with respect to the external heating device 80, the fixing roller 60, and the pressure roller 70 during the warm-up time between the start of the warm-up and the completion of the warm-up. In the present embodiment, the room temperature is 25° C., a temperature of the external heating device at the completion of the warm-up is 205° C. (T2), a temperature of the fixing roller at the completion of the warm-up is 185° C. (T3), and a temperature of the pressure roller at the completion of the warm-up is 150° C. (T4).

In temperature rise control performed with respect to the fixing apparatus 40 until the completion of the warm-up, the control device 90 distributes power to the external heating device 80, the fixing roller 60, and the pressure roller 70 in this order of priority. More specifically, all the power which is available for supply to the heat sources of the fixing apparatus 40 (hereinafter referred to as a total heat source power) are supplied to the respective heat sources (halogen lamps 86 and 87) of the heating rollers 81 and 82 until a surface temperature of the endless belt 83 of the external heating device 80 (temperature detected by the thermistor 85) reaches a second setting temperature (T2). Thereafter, when a surface temperature of the endless belt 83 reaches the second setting temperature (T2) and the warm-up of the external heating device 80 is completed, the total heat source power supplied to the halogen lamps 86 and 87 of the heating rollers 81 and 82 is distributed to the heat source (halogen lamp 64) of the fixing roller 60, so that a temperature of the fixing roller 60 is increased. Thereafter, when a surface temperature of the fixing roller 60 reaches the third setting temperature (T3) and the warm-up of the fixing roller 60 is completed, the total heat source power that has been distributed to the halogen lamps 86 and 87 of the external heating device 80 and the halogen lamp 64 of the fixing roller 60 is further distributed to the halogen lamp 74 of the pressure roller 70. Thereafter, when a surface temperature of the pressure roller 70 reaches the fourth setting temperature (T4) and the warm-up of the pressure roller 70 is completed, the warm-up of the whole fixing apparatus 40 is completed.

In performing the warm-up of the fixing apparatus 40, the control device 90 supplies power to the halogen lamps 86 and 87 of the heating rollers 81 and 82 in the external heating device 80 so as to cause the external heating device 80 to initiate a heating operation (S1). At this time, the control device 90 supplies to the halogen lamps 86 and 87 all of heating power which is available for use in heating the fixing roller 60, the pressure roller 70, and the external heating device 80 (halogen lamps 64, 74, 86, 87) in the fixing apparatus 40.

Next, the control device 90 determines whether a surface temperature of the endless belt 83, i.e. a temperature detected by the thermistor 85 has reached a first setting temperature T1 (S2). In the present embodiment, the first setting temperature T1 is 180° C. Note that time t1 between start of the warm-up operation and reach to the first setting temperature T1 is very short since a heat capacity of the external heating device 80 is small.

In S2, when having determined that the temperature detected by the thermistor 85 has not reach the first setting temperature T1, the control device 90 continues power supply to the halogen lamps 86 and 87 and continues monitoring whether the temperature detected by the thermistor 85 reaches the first setting temperature T1.

On the other hand, in S2, when having determined that the temperature detected by the thermistor 85 has reached the first setting temperature T1, the control device 90 controls the rotation driving device 91 to cause the fixing roller 60 to initiate rotation (S3). As a result of this, the fixing roller 60, the pressure roller 70, the external heating device 80 initiate rotation. Note that when the fixing roller 60 initiates rotation, a surface temperature of the endless belt 83 temporarily drops and then rises, as illustrated in FIG. 3.

Thereafter, the control device 90 monitors whether the temperature detected by the thermistor 85 has reached the second setting temperature T2 (S4).

When the temperature detected by the thermistor 85 has reached the second setting temperature T2, the control device 90 supplies the heating power, which has been supplied to only the halogen lamps 86 and 87 of the external heating device 80 until then, to the halogen lamp 64 of the fixing roller 60 as well as the halogen lamps 86 and 87 (S5). Specifically, when the temperature detected by the thermistor 85 reaches the second setting temperature T2, the control device 90 performs control to decrease the amount of power to be supplied to the halogen lamps 86 and 87 to such a degree that the surface temperature of the endless belt 83 is maintained at the second setting temperature T2, and supplies the corresponding heating power to the halogen lamp 64. Alternatively, when the thermistor 85 detects the second setting temperature T2 or higher temperatures, power is supplied to only the halogen lamp 64. As illustrated in FIG. 3, the surface temperature of the fixing roller 60 increases to a certain temperature (approximately 160° C. in FIG. 3) due to heat transmission from the endless belt 83 by the time when the temperature detected by the thermistor 85 reaches the second setting temperature T2.

Next, the control device 90 determines whether a surface temperature of the fixing roller 60, i.e. a temperature detected by the thermistor 65 has reached the third setting temperature T3 (S6). In S6, when having determined that the temperature detected by the thermistor 65 has not reach the third setting temperature T3, the control device 90 continues power supply to the halogen lamp 64 and the halogen lamps 86 and 87 and continues monitoring whether the temperature detected by the thermistor 65 reaches the third setting temperature T3.

On the other hand, in S6, when having determined that the temperature detected by the thermistor 65 has reached the third setting temperature T3, the control device 90 supplies the heating power, which has been supplied to the halogen lamp 64 and the halogen lamps 86 and 87 until then, to the halogen lamp 74 of the pressure roller 70 as well as the halogen lamp 64 and the halogen lamps 86 and 87 (S7). More specifically, when the temperature detected by the thermistor 65 reaches the third setting temperature T3, the control device 90 performs control to decrease the amount of power to be supplied to the halogen lamps 86 and 87 to such a degree that the surface temperature of the endless belt 83 is maintained at the second setting temperature T2, performs control to decrease the amount of power to be supplied to the halogen lamp 64 to such a degree that the surface temperature of the fixing roller 60 is maintained at the third setting temperature T3, and supplies the corresponding heating power to the halogen lamp 74. Alternatively, when the thermistor 65 detects the third setting temperature T3 or higher temperatures, and the thermistor 85 detects the second setting temperature T2 or higher temperatures, power is supplied to only the halogen lamp 74. As illustrated in FIG. 3, the surface temperature of the pressure roller 70 increases to a certain temperature (approximately 130° C. in FIG. 3) due to heat transmission from the fixing roller 60 by the time when the temperature detected by the thermistor 65 reaches the third setting temperature T3.

Thereafter, the control device 90 determines whether a surface temperature of the pressure roller 70, i.e. a temperature detected by the thermistor 75 has reached the fourth setting temperature T4 (S8). When having determined that the temperature detected by the thermistor 75 has not reached the fourth setting temperature T4, the control device 90 continues power supply to the halogen lamps 64 and 74 and the halogen lamps 86 and 87 and continues monitoring whether the temperature detected by the thermistor 75 reaches the fourth setting temperature T4.

On the other hand, in S8, when having determined that the temperature detected by the thermistor 75 has reached the fourth setting temperature T4, the control device 90 completes the warm-up operation of the fixing apparatus 40. This allows the fixing apparatus 40 to perform a fixing process. After the completion of the warm-up, rotation of the fixing roller 60 is stopped, which stops rotation of the endless belt 83 of the external heating device 80 and the rotation of the pressure roller 70. In this state, the fixing apparatus 40 is in the standby mode.

As described above, the first priority for temperature rise is given to the heating rollers 81 and 82 of the external heating device 80. This allows heat from the heating rollers 81 and 82 to be transmitted to the fixing roller 60 via the endless belt 83 during a time when the operation for temperature rise of the heating rollers 81 and 82 is performed. Thus, it is possible to efficiently increase a temperature of only the surface of the fixing roller 60, and it is possible to constantly make the temperatures of the heating rollers 81 and 82 remain higher than that of the fixing roller 60.

In the present embodiment, a rotation start temperature (T1, first setting temperature: 180° C.) of the external heating device 80 is set so as to be different from a warm-up completion temperature (T2, second setting temperature: 250° C.). However, the rotation start temperature may be higher or lower than the warm-up completion temperature. In this case, it is necessary to start rotation at a temperature of not more than a control temperature of the external heating device 80 (second setting temperature 205 C).

Figure 5:
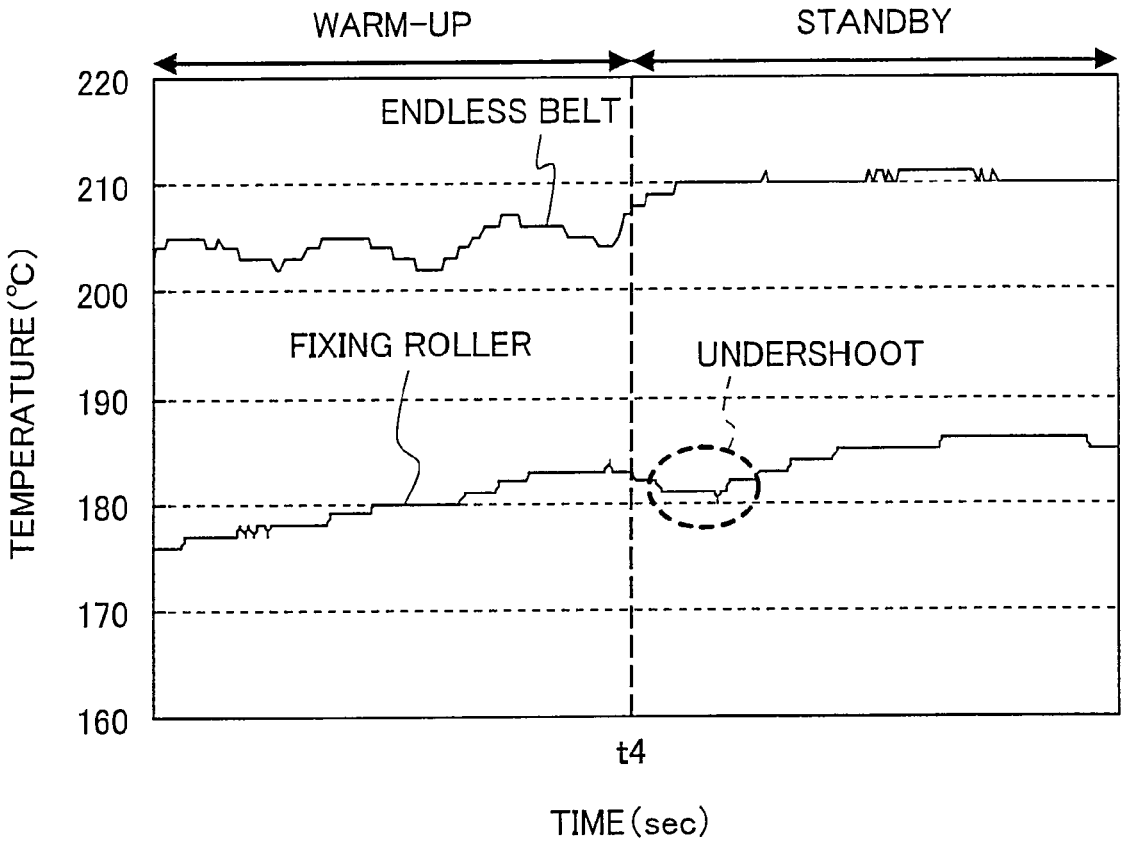
FIG. 5 is graph showing the progression of surface temperatures of the endless belt of the external heating device and the fixing roller during a time between immediately before and after the completion of the warm-up.

Next, the following describes the progression of temperatures in the above-mentioned warm-up operation of the fixing apparatus 40 during a time between immediately before and after the completion of the warm-up. FIG. 5 is an enlarged view of the progression of surface temperatures of the endless belt 83 of the external heating device 80 and the fixing roller 60 during a time between immediately before and after the completion of the warm-up.

As illustrated in FIG. 3, the fixing apparatus 40 completes the warm-up at time t4, and rotation of the fixing roller is stopped. When the rotation is stopped, there occurs undershoot in the fixing roller 60, as illustrated in FIG. 5. In FIG. 5, undershoot occurs, and overshoot can occur.

As described previously, in order to prevent cold offset and hot offset in which part of the toner formed on the recording paper P sticks onto the surface of the fixing roller 60, a surface temperature of the fixing roller 60 must be maintained within the common non-offset range. In the present embodiment, the warm-up completion temperature of the fixing roller 60 (third setting temperature T3: control temperature) is 185° C. Thus, the surface temperature of the fixing roller 60 must be within a tolerance of ±5° C. from 185° C. (temperature ripple is within 10° C.). Even in a situation where the common non-offset range is 10° C. or more, there occurs difference in degree of glossiness on an image fixed onto the recording paper P between when a surface temperature of the fixing roller 60 is high and when a surface temperature of the fixing roller 60 is low. Thus, it is preferable that ripple of the surface temperature of the fixing roller 60 is within 10° C.

Next, in the fixing apparatus 40, undershoot and overshoot of the surface temperature of the fixing roller 60 after the completion of the warm-up was studied in a case where (a) control temperature of the external heating device 80 (difference in surface temperature between the external heating device 80 and the fixing roller 60) and (b) a nip length of the nip area provided when the endless belt 83 of the external heating device 80 comes into contact with the fixing roller 60 are changed. Results of the study is shown in FIG. 6.

In the measurement in the present embodiment, in order to change the nip length, a disconnection system for disconnecting the external heating device 80 from the fixing roller 60 was attached to the external heating device 80, and the disconnection system was operated. The disconnection system is a known system and allows the external heating device 80 to move in a direction that the external heating device 80 approaches the fixing roller 60 and in a direction that the external heating device 80 recedes from the fixing roller 60.

Values in FIG. 6 indicate overshoot and undershoot on the surface of the fixing roller 60 immediately after the completion of the warm-up. Note that negative values indicate undershoot. In FIG. 6, in order to obtain 5° C. or fewer undershoot immediately after the completion of the warm-up, i.e. in order to maintain the surface temperature of the fixing roller 60 immediately after the completion of the warm-up to be a temperature of not less than 180° C. and not more than 185° C., which is the warm-up completion temperature (third setting temperature T3: control temperature) of the fixing roller 60, difference in surface temperature between the fixing roller 60 and the external heating device 80 must be 25° C. or fewer when a nip length of the nip area provided between the external heating device 80 and the fixing roller 60 is 20 mm, 35° C. or fewer when the nip length is 10 mm, and 60° C. or fewer when the nip length is 3 mm.

Similarly, in order to obtain 5° C. or fewer overshoot immediately after the completion of the warm-up, i.e. in order to maintain the surface temperature of the fixing roller 60 immediately after the completion of the warm-up to be a temperature of not less than 185° C., which is the warm-up completion temperature (third setting temperature T3: control temperature) of the fixing roller 60, and not more than 190° C., difference in surface temperature between the fixing roller 60 and the external heating device 80 must be 5° C. or greater when a nip length of the nip area provided between the external heating device 80 and the fixing roller 60 is 20 mm, 15° C. or greater when the nip length is 10 mm, and 35° C. or greater when the nip length is 3 mm. Note that in a case where 20 mm or greater nip length can be secured between the external heating device 80 and the fixing roller 60, overshoot of the fixing roller 60 is less likely to occur even when there is almost no difference in surface temperature between the external heating device 80 and the fixing roller 60.

Figure 7:
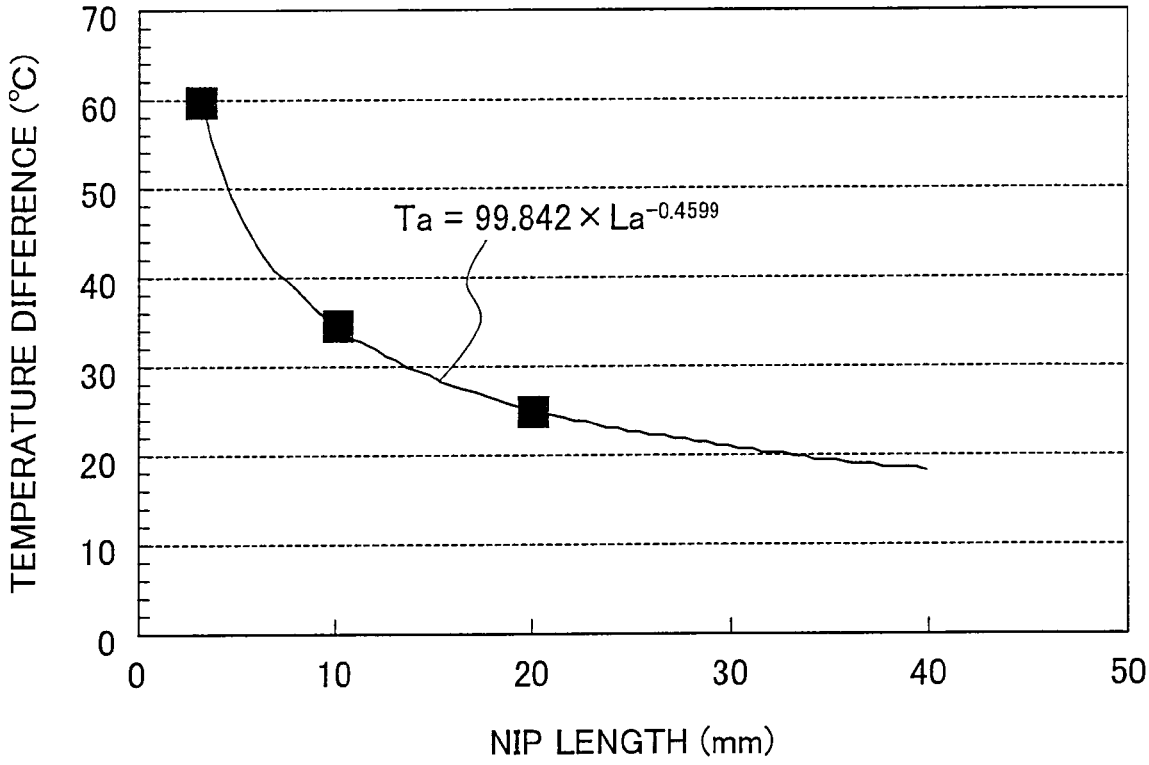
FIG. 7 is a graph showing a relationship between a nip length La of the nip area provided between the external heating device and the fixing roller and a temperature difference Ta between the surface temperature of the fixing roller and the surface temperature of the external heating device, in a case where undershoot occurred immediately after the completion of the warm-up of the fixing roller is in the range within 5° C. from the warm-up completion temperature of the fixing roller.

Next, in order to prevent cold offset of the fixing apparatus 40, the inventors of the present invention examined conditions under which undershoot occurred immediately after the completion of the warm-up of the fixing roller 60 is in the range within 5° C. from the warm-up completion temperature of the fixing roller 60 (third setting temperature T3: control temperature). FIG. 7 is a graph showing an approximated curve by plotting results of measurement when an horizontal axis is a nip length La of the nip area provided by the external heating device 80 and the fixing roller 60 and a longitudinal axis is a temperature difference Ta between the surface temperature of the fixing roller 60 and the surface temperature of the external heating device 80. The approximated curve is represented by the following equation (1):

$$Ta=99.842\times La^{-0.4599} \quad (1).$$

Therefore, when the temperature difference is lower than a value obtained by the approximated curve represented by the equation (1), the undershoot of the fixing roller 60 is controlled to within 5° C. from the warm-up completion temperature of the fixing roller 60 (third setting temperature T3: control temperature). Thus, a temperature difference Ta between the control temperature T2 of the external heating device 80 and the control temperature T3 of the fixing roller 60 should be:

$$Ta\leqq 99.842\times La^{-0.4599} \quad (2).$$

Figure 8:
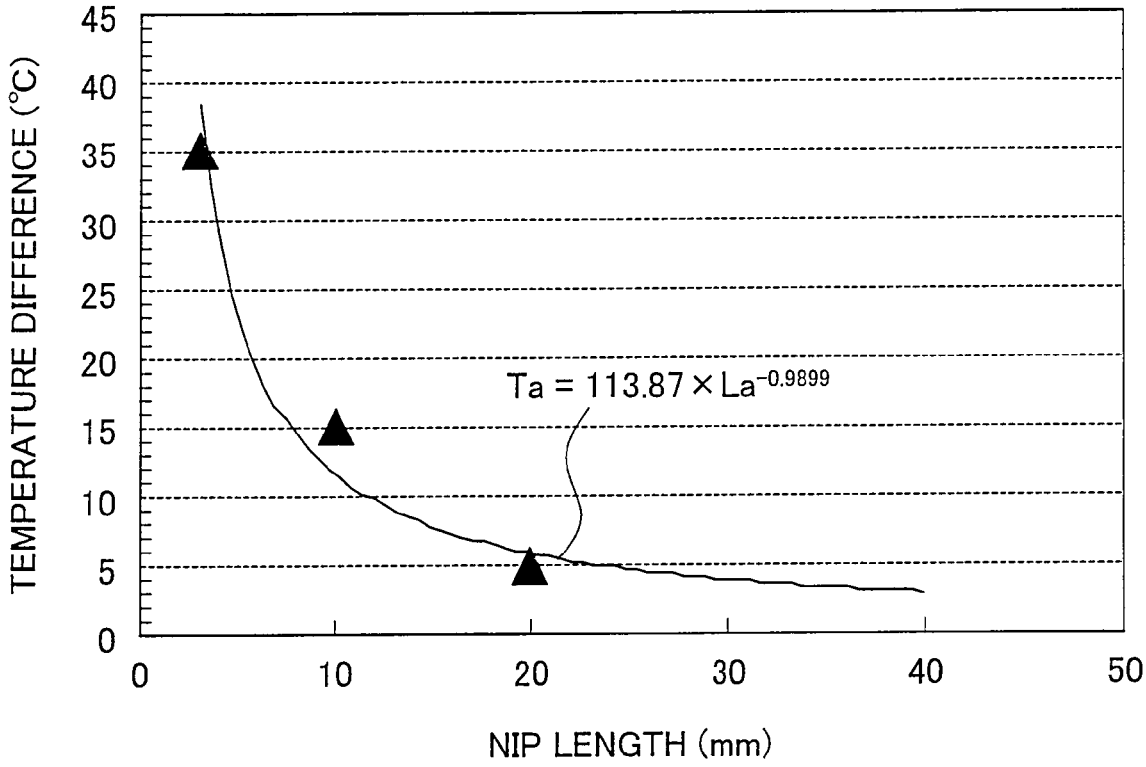
FIG. 8 is a graph showing a relationship between a nip length La of the nip area provided between the external heating device and the fixing roller and a temperature difference Ta between the surface temperature of the fixing roller and the surface temperature of the external heating device, in a case where overshoot occurred immediately after the completion of the warm-up of the fixing roller is in the range within 5° C. from the warm-up completion temperature of the fixing roller.

Meanwhile, in a case where a nip area provided between the external heating device 80 and the fixing roller 60 is small, or in a case where a difference between the control temperature of the external heating device 80 and the control temperature of the fixing roller 60 is small, there occurs overshoot. In order to prevent hot offset of the fixing apparatus 40, the inventors of the present invention examined conditions under which overshoot occurred immediately after the completion of the warm-up of the fixing roller 60 is in the range within 5° C. from the warm-up completion temperature of the fixing roller 60 (third setting temperature T3: control temperature). FIG. 8 is a graph showing an approximated curve by plotting results of measurement when an horizontal axis is a nip length La of the nip area provided by the external heating device 80 and the fixing roller 60 and a longitudinal axis is a temperature difference Ta between the surface temperature of the fixing roller 60 and the surface temperature of the external heating device 80. The approximated curve is represented by the following equation (3):

$$Ta=113.87\times La^{-0.9899} \quad (3).$$

Therefore, when the temperature difference is larger than a value obtained by the approximated curve represented by the equation (3), the overshoot of the fixing roller 60 is controlled to within 5° C. from the warm-up completion temperature of the fixing roller 60 (third setting temperature T3: control temperature). Thus, a temperature difference Ta between the control temperature T2 of the external heating device 80 and the control temperature T3 of the fixing roller 60 should be:

$$Ta\leqq 113.87\times La^{-0.9899} \quad (4).$$

From the equations (2) and (4), conditions under which the undershoot and overshoot of the fixing roller 60 immediately after the completion of the warm-up are controlled to within 5° C. from the warm-up completion temperature of the fixing roller 60 (third setting temperature T3: control temperature) are represented by the equation (5):

$$113.87\times La^{-0.9899}\leqq Ta\leqq 99.842\times La^{-0.4599} \quad (5).$$

By controlling the temperature difference Ta between the surface temperature of the fixing roller 60 and the surface temperature of the external heating device 80 according to the equation (5), it is possible to set an appropriate temperature of the external heating device 80 which temperature suppresses overshoot and undershoot of the fixing roller 60 in the nip area provided between the external heating device 80 and the fixing roller 60. This makes it possible to obtain an excellent fixed image without hot offset or cold offset when paper passing operation is performed after the warm-up of the fixing apparatus 40 is completed.

As described previously, in a case where 20 mm or greater nip length can be secured between the endless belt 83 of the external heating device 80 and the fixing roller 60, overshoot of the fixing roller 60 is less likely to occur even when there is almost no temperature difference between the control temperature of the external heating device 80 and the control temperature of the fixing roller 60. In view of this, the control temperature of the external heating device 80 may be set to fall within the equation (2).

Note that the arrangement in which a relationship between the nip length La (nip length provided by the external heating device 80 and the fixing roller 60) and the temperature Ta (temperature difference between the surface temperature of the fixing roller 60 and the surface temperature of the external heating device 80) is controlled in the manner as described above is easily realized by using (i) the disconnection system which causes the external heating device 80 to move with respect to the fixing roller 60 and (ii) the control device 90 as appropriate.

The fixing apparatus of the present invention is, for example, a fixing apparatus for use in an image forming apparatus which is capable of changing a transport speed of a recording paper upon switching between color printing and monochrome printing and has a narrow common non-offset range (range in which no offset occurs both at the fixing of a color toner image and at the fixing of a monochrome toner image).

As described above, a fixing apparatus of the present invention is a fixing apparatus including: a fixing member which has a heat source and an elastic layer therein, the elastic layer being located close to an outer surface of the fixing member in relation to the heat source; a pressure member which is pressed against the fixing member so that a first nip area is provided between the pressure member and the fixing member, the first nip area causing a toner image formed on a recording paper to be fixed on the recording paper; and an external heating device which has a heat source and is disposed on the outer surface of the fixing member so that a second nip area, which is a contact area where the external heating device is in contact with the fixing member, is provided between the external heating device and the fixing member, wherein it is $Ta\leqq 99.842\times La^{-0.4599}$ where Ta is a difference between a surface temperature of the fixing member and a surface temperature of the external heating device and La is a length of the second nip area in a direction of transport of the recording paper.

According to the above arrangement, a relationship between the difference Ta between the surface temperature of the external heating device and the surface temperature of the fixing member and the length La of the second nip area in a direction of transport of the recording paper is set to be a relationship that can prevent cold offset caused by undershoot of the surface temperature of the fixing member. Thus, it is possible to perform fixing operation without cold offset.

That is, it is possible to suppress undershoot of the surface temperature of the fixing member to within a range where cold offset of the fixing apparatus can be prevented, by setting the difference Ta between the surface temperatures of the external heating device and the fixing member (control temperature difference: setting temperature difference) and the nip length La so as to satisfy the above relationship. In this case, the amount of heat supplied from the external heating device to the fixing member changes in accordance with the nip length La of the nip area provided between the external heating device and the fixing member. Thus, a proper value of the difference between the surface temperatures of the external heating device and the fixing member changes in accordance with the nip length La.

Further, the fixing apparatus of the present invention includes: a fixing member which has a heat source and an elastic layer therein, the elastic layer being located close to an outer surface of the fixing member in relation to the heat source; a pressure member which is pressed against the fixing member so that a first nip area is provided between the pressure member and the fixing member, the first nip area causing a toner image formed on a recording paper to be fixed on the recording paper; and an external heating device which has a heat source and is disposed on the outer surface of the fixing member so that a second nip area, which is a contact area where the external heating device is in contact with the fixing member, is provided between the external heating device and the fixing member, wherein it is $113.87\times La^{-0.9899}\leqq Ta$ where Ta is a difference between a surface temperature of the fixing member and a surface temperature of the external heating device and La is a length of the second nip area in a direction of transport of the recording paper.

According to the above arrangement, a relationship between the difference Ta between the surface temperature of the external heating device and the surface temperature of the fixing member and the length La of the second nip area in a direction of transport of the recording paper is set to be a relationship that can prevent hot offset caused by overshoot of the surface temperature of the fixing member. Thus, it is possible to perform fixing operation without hot offset.

That is, it is possible to suppress overshoot of the surface temperature of the fixing member to within a range where hot offset of the fixing apparatus can be prevented, by setting the difference Ta between the surface temperatures of the external heating device and the fixing member (control temperature difference: setting temperature difference) and the nip length La so as to satisfy the above relationship. In this case, the amount of heat supplied from the external heating device to the fixing member changes in accordance with the nip length La of the nip area provided between the external heating device and the fixing member. Thus, a proper value of the difference between the surface temperatures of the external heating device and the fixing member changes in accordance with the nip length La.

Still further, the fixing apparatus of the present invention is a fixing apparatus including: a fixing member which has a heat source and an elastic layer therein, the elastic layer being located close to an outer surface of the fixing member in relation to the heat source; a pressure member which is pressed against the fixing member so that a first nip area is provided between the pressure member and the fixing member, the first nip area causing a toner image formed on a recording paper to be fixed on the recording paper; and an external heating device which has a heat source and is disposed on the outer surface of the fixing member so that a second nip area, which is a contact area where the external heating device is in contact with the fixing member, is provided between the external heating device and the fixing member, wherein it is $113.87\times La^{-0.9899}\leqq Ta\leqq 99.842\times La^{-0.4599}$ where Ta is a difference between a surface temperature of the fixing member and a surface temperature of the external heating device and La is a length of the second nip area in a direction of transport of the recording paper.

According to the above arrangement, a relationship between the difference Ta between the surface temperature of the external heating device and the surface temperature of the fixing member and the length La of the second nip area in a direction of transport of the recording paper is set to be a relationship that can prevent cold offset and hot offset caused by undershoot of the surface temperature of the fixing member. Thus, it is possible to perform fixing operation without cold offset and hot offset.

That is, it is possible to suppress undershoot and overshoot of the surface temperature of the fixing member to within a range where cold offset and hot offset of the fixing apparatus can be prevented, by setting the difference Ta between the surface temperatures of the external heating device and the fixing member (control temperature difference: setting temperature difference) and the nip length La so as to satisfy the above relationship. In this case, the amount of heat supplied from the external heating device to the fixing member changes in accordance with the nip length La of the nip area provided between the external heating device and the fixing member. Thus, a proper value of the difference between the surface temperatures of the external heating device and the fixing member changes in accordance with the nip length La.

The above fixing apparatus may be arranged such that the external heating device includes: a plurality of rollers, at least one of which has a heat source; and a belt which is set over the plurality of rollers and pressed against the fixing member so that the second nip area is provided between the belt and the fixing member.

According to the above arrangement, there is the nip area between a belt set over a plurality of rollers in the external heating device and the fixing member. A length of the nip area can be larger. Thus, it is possible to more efficiently perform heat supply from the external heating device to the fixing member via a large nip area. Since it is possible to efficiently perform heat supply from the external heating device to the fixing member, it is possible to reduce a difference in temperature between the external heating device and the fixing member. Thus, the control temperature (setting temperature) of the external heating device can be set to a low temperature. This makes it possible to reduces a warm-up time.

The above fixing apparatus may be arranged so as to further include control means which controls power supply to the heat source of the fixing member and the heat source of the external heating device, the control means giving a first priority to power supply to the heat source of the external heating device until the external heating device reaches a setting temperature for warm-up.

According to the above arrangement, the first priority is given to power supply to the external heating device until the external heating device reaches the setting temperature for warm-up. With this arrangement, even when a temperature of the external heating device is lower than a temperature of the fixing member before the warm-up operation, the external heating device reaches the setting temperature earlier than the fixing member at the warm-up operation. This makes it possible to provide a uniform temperature difference between the fixing member and the external heating device. As a result this, it is possible to suppress overshoot of the fixing member after the completion of the warm-up, and to prevent hot offset.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area is provided between the external heating device and the fixing member, and a control device configured to control a temperature difference between a surface temperature of the external heating device and a surface temperature of the fixing member in accordance with a length of the second nip area in a direction of transport of the recording paper, so that the surface temperature of the fixing member is maintained to fall within a temperature range in which offset does not occur, the offset being a phenomenon in which part of a toner formed on the recording paper sticks onto a surface of the fixing member due to overheating or insufficient heating of the recording paper, wherein the control device is configured to control power supply to the heat source of the fixing member and the heat source of the external heating device giving a first priority to power supply to the heat source of the external heating device until the external heating device reaches a setting temperature for warm-up.

2. The fixing apparatus according to claim 1, wherein the external heating device comprises: a plurality of rollers, at least one of which has a heat source; and a belt which is set over the plurality of rollers and pressed against the fixing member so that the second nip area is provided between the belt and the fixing member.

3. The fixing apparatus according to claim 2, wherein the fixing member is a fixing roller and has the heat source which heats when power is supplied to the heat source, the pressure member is a pressure roller and is rotated in opposite direction to rotation of the fixing roller, and the belt of the external heating device is supported by the plurality of rollers of the external heating device so as to be along a curved outer surface of the fixing roller.

4. An image forming apparatus comprising:

a fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area is provided between the external heating device and the fixing member, and a control device configured to control a temperature difference between a surface temperature of the external heating device and a surface temperature of the fixing member in accordance with a length of the second nip area in a direction of transport of the recording paper, so that the surface temperature of the fixing member is maintained to fall within a temperature range in which offset does not occur, the offset being a phenomenon in which part of a toner formed on the recording paper sticks onto a surface of the fixing member due to overheating or insufficient heating of the recording paper, wherein the control device is configured to control power supply to the heat source of the fixing member and the heat source of the external heating device giving a first priority to power supply to the heat source of the external heating device until the external heating device reaches a setting temperature for warm-up.

5. A fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area, which is a contact area where the external heating device is in contact with the fixing member, is provided between the external heating device and the fixing member, and a control device configured to control a temperature difference Ta, wherein $Ta \leqq 99.842 \times La^{-0.4599}$ where Ta is a difference between a surface temperature of the fixing member and a surface temperature of the external heating device and La is a length of the second nip area in a direction of transport of the recording paper, wherein the control device is configured to control power supply to the heat source of the fixing member and the heat source of the external heating device giving a first priority to power supply to the heat source of the external heating device until the external heating device reaches a setting temperature for warm-up.

6. The fixing apparatus according to claim 5, wherein the external heating device comprises: a plurality of rollers, at least one of which has a heat source; and a belt which is set over the plurality of rollers and pressed against the fixing member so that the second nip area is provided between the belt and the fixing member.

7. The fixing apparatus according to claim 6, wherein the fixing member is a fixing roller and has the heat source which heats when power is supplied to the heat source, the pressure member is a pressure roller and is rotated in opposite direction to rotation of the fixing roller, and the belt of the external heating device is supported by the plurality of rollers of the external heating device so as to be along a curved outer surface of the fixing roller.

8. An image forming apparatus comprising:

a fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area, which is a contact area where the external heating device is in contact with the fixing member, is provided between the external heating device and the fixing member, and a control device configured to control a temperature difference Ta, wherein $Ta \leqq 99.842 \times La^{-0.4599}$ where Ta is a difference between a surface temperature of the fixing member and a surface temperature of the external heating device and La is a length of the second nip area in a direction of transport of the recording paper, wherein the control device is configured to control power supply to the heat source of the fixing member and the heat source of the external heating device giving a first priority to power supply to the heat source of the external heating device until the external heating device reaches a setting temperature for warm-up.

9. A fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area, which is a contact area where the external heating device is in contact with the fixing member, is provided between the external heating device and the fixing member, and a control device configured to control a temperature difference Ta, wherein $113.87 \times La^{-0.9899} \leqq Ta$ where Ta is a difference between a surface temperature of the fixing member and a surface temperature of the external heating device and La is a length of the second nip area in a direction of transport of the recording paper, wherein the control device is configured to control power supply to the heat source of the fixing member and the heat source of the external heating device giving a first priority to power supply to the heat source of the external heating device until the external heating device reaches a setting temperature for warm-up.

10. The fixing apparatus according to claim 9, wherein the external heating device comprises: a plurality of rollers, at least one of which has a heat source; and a belt which is set over the plurality of rollers and pressed against the fixing member so that the second nip area is provided between the belt and the fixing member.

11. The fixing apparatus according to claim 10, wherein the fixing member is a fixing roller and has the heat source which heats when power is supplied to the heat source, the pressure member is a pressure roller and is rotated in opposite direction to rotation of the fixing roller, and the belt of the external heating device is supported by the plurality of rollers of the external heating device so as to be along a curved outer surface of the fixing roller.

12. An image forming apparatus comprising:

a fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area, which is a contact area where the external heating device is in contact with the fixing member, is provided between the external heating device and the fixing member, and a control device configured to control a temperature difference Ta, wherein $113.87 \times La^{-0.9899} \leqq Ta$ where Ta is a difference between a surface temperature of the fixing member and a surface temperature of the external heating device and La is a length of the second nip area in a direction of transport of the recording paper, wherein the control device is configured to control power supply to the heat source of the fixing member and the heat source of the external heating device giving a first priority to power supply to the heat source of the external heating device until the external heating device reaches a setting temperature for warm-up.

13. A fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area, which is a contact area where the external heating device is in contact with the fixing member, is provided between the external heating device and the fixing member, and a control device configured to control a temperature difference Ta, wherein $113.87 \times La^{-0.9899} \leqq Ta \leqq 99.842 \times La^{-0.4599}$ where Ta is a difference between a surface temperature of the fixing member and a surface temperature of the external heating device and La is a length of the second nip area in a direction of transport of the recording paper, wherein the control device is configured to control power supply to the heat source of the fixing member and the heat source of the external heating device giving a first priority to power supply to the heat source of the external heating device until the external heating device reaches a setting temperature for warm-up.

14. The fixing apparatus according to claim 13, wherein the external heating device comprises: a plurality of rollers, at least one of which has a heat source; and a belt which is set over the plurality of rollers and pressed against the fixing member so that the second nip area is provided between the belt and the fixing member.

15. The fixing apparatus according to claim 14, wherein the fixing member is a fixing roller and has the heat source which heats when power is supplied to the heat source, the pressure member is a pressure roller and is rotated in opposite direction to rotation of the fixing roller, and the belt of the external heating device is supported by the plurality of rollers of the external heating device so as to be along a curved outer surface of the fixing roller.

16. An image forming apparatus comprising:

a fixing apparatus comprising:

a fixing member which has a heat source and an elastic layer therein, the elastic layer being located close to an outer surface of the fixing member in relation to the heat source;

a pressure member which is pressed against the fixing member so that a first nip area is provided between the pressure member and the fixing member, the first nip area causing a toner image formed on a recording paper to be fixed on the recording paper;

an external heating device which has a heat source and is disposed on the outer surface of the fixing member so that a second nip area, which is a contact area where the external heating device is in contact with the fixing member, is provided between the external heating device and the fixing member, and a control device configured to control a temperature difference Ta, wherein $113.87\times La^{-0.9899} \leqq Ta \leqq 99.842\times La^{-0.4599}$ where Ta is a difference between a surface temperature of the fixing member and a surface temperature of the external heating device and La is a length of the second nip area in a direction of transport of the recording paper, wherein the control device is configured to control power supply to the heat source of the fixing member and the heat source of the external heating device giving a first priority to power supply to the heat source of the external heating device until the external heating device reaches a setting temperature for warm-up.

* * * * *